United States Patent [19]

Goldfarb

[11] 4,257,600

[45] Mar. 24, 1981

[54] TILTABLE GAME TABLE WITH TIME CONTROLLED LOCKING MECHANISM

[76] Inventor: Adolph E. Goldfarb, 4614 Monarca Dr., Tarzana, Calif. 91356

[21] Appl. No.: 8,961

[22] Filed: Feb. 2, 1979

[51] Int. Cl.[3] ..... A63F 7/38; A63F 7/02

[52] U.S. Cl. ..... 273/110; 273/113

[58] Field of Search ..... 273/110, 113, 120 R, 273/129 Q, 129 P, 115, 109, 399, 317, 122 R, 118 R, 1 GP; 46/43, 42

[56] References Cited

U.S. PATENT DOCUMENTS

| | | | |
|---|---|---|---|
| 432,589 | 6/1890 | Wooster | 273/115 |
| 713,072 | 11/1902 | Marais | 273/113 |
| 1,044,248 | 11/1912 | Robinson | 46/43 |
| 1,840,203 | 1/1932 | Kimbal | 273/110 |
| 3,228,688 | 1/1966 | Dennison | 273/85 R |
| 3,384,374 | 5/1968 | Boothe | 273/110 |
| 3,710,455 | 1/1973 | Liversidge et al. | 273/1 R |
| 3,807,737 | 4/1974 | Breslow | 273/122 R |
| 4,034,985 | 7/1977 | Breslow et al. | 273/110 |

FOREIGN PATENT DOCUMENTS

| | | | |
|---|---|---|---|
| 1507925 | 12/1967 | France | 273/110 |
| 17258 | of 1901 | United Kingdom | 273/110 |

*Primary Examiner*—Richard C. Pinkham
*Assistant Examiner*—Scott L. Brown
*Attorney, Agent, or Firm*—Romney, Schaap, Golant, Disner & Ashen

[57] ABSTRACT

A time reaction game apparatus having a tiltable playing surface which is at least slightly convexed and has a goal located at or near the high point thereof. The goal may be in the form of a recess adapted to receive a playing ball. A timer is set and a ball is released onto the playing surface. The player of the game operates a manually actuable mechanism such as a remote joystick to tilt the playing surface to cause the playing ball to enter the goal. When the player is successful, the ball enters the goal, which automatically releases the next ball onto the playing surface. The timer goes off after a predetermined time period, and the goal may be automatically blocked as for example, by blocking the recess.

34 Claims, 7 Drawing Figures

FIG. 3
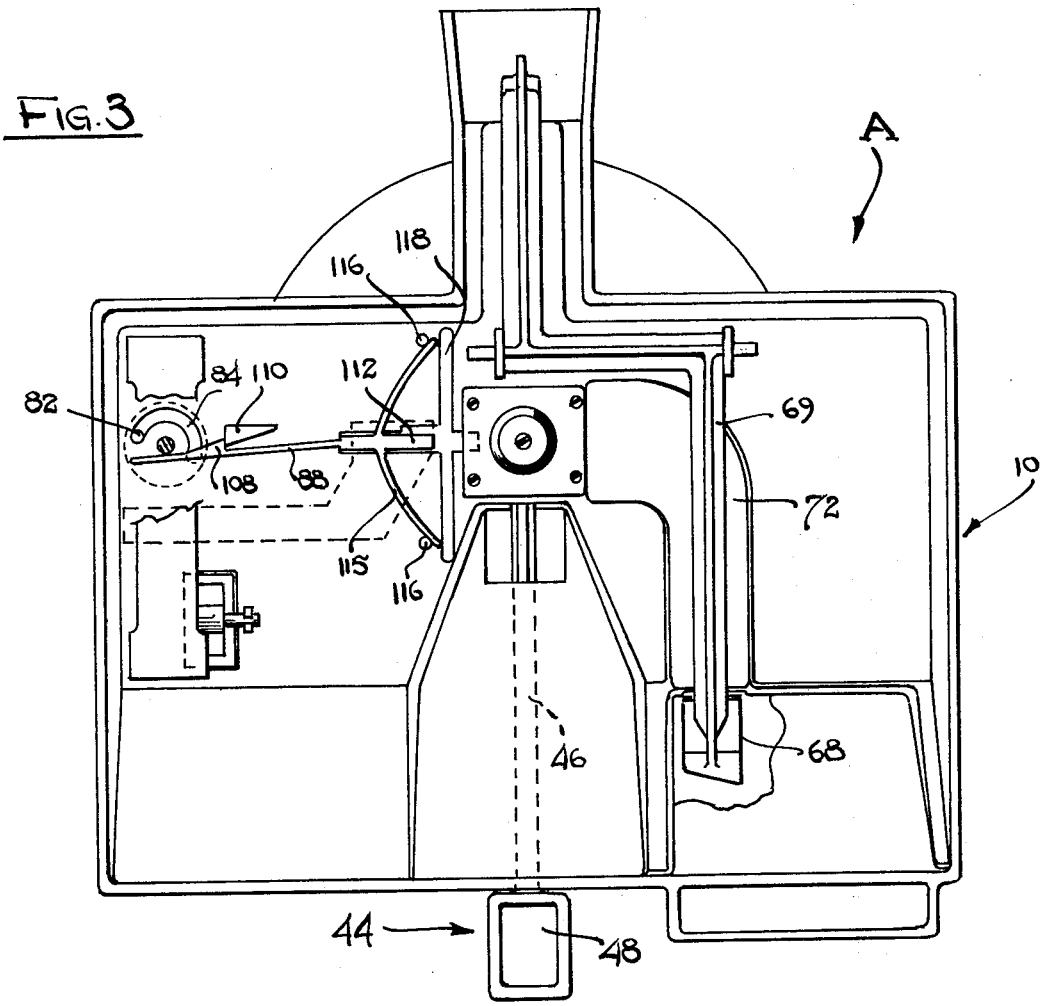
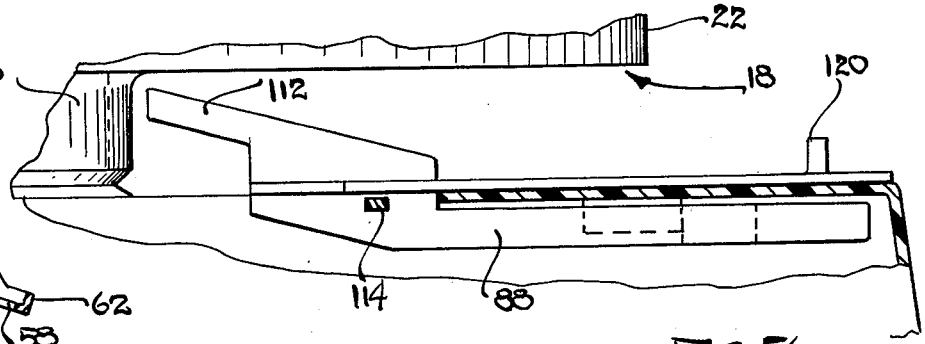
FIG. 7
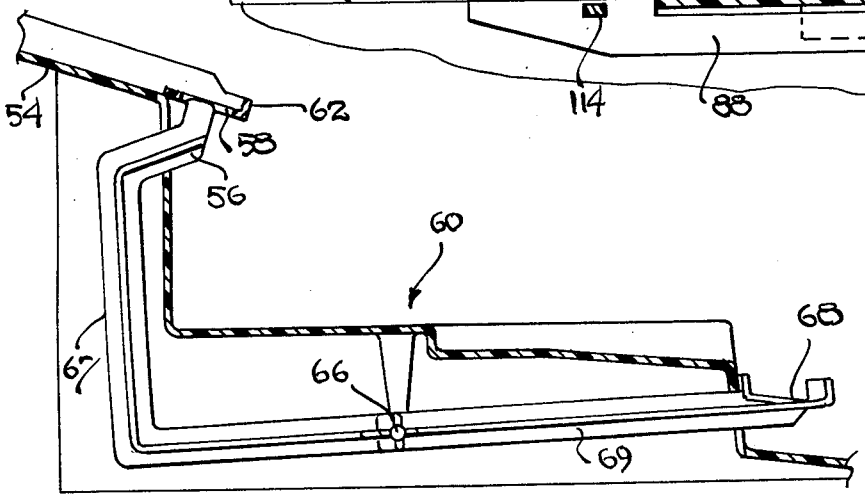
FIG. 4

TILTABLE GAME TABLE WITH TIME CONTROLLED LOCKING MECHANISM

BACKGROUND OF THE INVENTION

1. Field of the Invention

This invention relates in general to certain new and useful improvements in game apparatus, and more particularly a game apparatus in which one or more players attempt to manipulate a playing surface in an attempt to cause a ball to roll into a goal area.

2. Brief Description of Prior Art

There has been a commercially available game comprised of a disc having a flat playing surface with a goal in the form of an opening located in the center thereof and with a transparent tube located beneath the opening to receive one or more playing balls. The disc was provided with a plurality of handles spaced around the periphery for being grasped by the players to manipulate the playing surface. Each player attempts to manipulate the disc in such manner as to cause the playing balls of the opponent player or players to fall into the opening, and also to prevent his or her own playing ball from entering opening.

There was another prior game apparatus in which one or more players attempted to manipulate one or more balls into a plurality of holes on a playing surface by moving the surface to cause the balls to move through a maze and into these holes which represented scoring areas.

These games, among other things, were not time-operated and did not include automatic release means for releasing another of the playing balls after a ball entered the goal opening.

OBJECTS OF THE INVENTION

It is, therefore, a primary object of the present invention to provide a game apparatus in which a player attempts to manipulate a crowned playing surface in a manner to cause a rolling ball to move into a scoring area located at or near a high point thereof.

It is another object of the present invention to provide a game apparatus of the type stated in which the playing surface is tiltable by a joystick manually actuable by a player and in which the player attempts to tilt the playing surface in order to cause a rolling ball to move into the scoring area.

It is a further object of the present invention to provide a game apparatus of the type stated in which a player manipulates a playing surface in an attempt to cause a ball to roll into a scoring area within a predetermined time period and after which time period the scoring area is blocked.

It is an additional object of the present invention to provide a game apparatus of the type stated in which an automatic ball release mechanism operates to release a playing ball after a ball enters a scoring area.

It is another salient object of the present invention to provide a game apparatus of the type stated which is provided with a timing mechanism such that the player attempts to move a ball on a convex playing surface by tilting the convex playing surface and into a scoring recess and which recess is blocked after a time period.

It is yet another object of the present invention to provide a method of playing a time reaction game in which a player manually operates a joystick to manipulate a playing surface and cause a playing ball to roll into a scoring area within a predetermined time period.

With the above and other objects in view, my invention resides in the novel features of form, construction, arrangement, and combination of parts presently described and pointed out in the claims.

SUMMARY OF THE DISCLOSURE

A game apparatus which is comprised of a tiltable table having an upper playing surface which is slightly convexed and has a scoring area at or near a high point thereof and preferably at the center thereof. The game apparatus utilizes one or more playing balls and comprises a manually actuable remotely located control in the form of a joystick which is connected to an operable causing movement of the table as for example, tilting movement of the table.

The player attempts to manipulate the control member in order to tilt the table so that a playing ball will roll up the convex playing surface and into the goal or scoring area such as a recess or opening formed in the playing surface.

The illustrated game functions as a time reaction game and is provided with a timer mechanism operated to block the goal area after a predetermined time period. Specifically, the timing mechanism causes an element to shift into the scoring recess to prevent any playing balls from entering the scoring recess after the predetermined time period. In addition means may be provided to lock the table and/or the control member in position after the predetermined time interval.

The game apparatus also comprises an automatic ball release mechanism which is operable to release a playing ball from a ball dispensing means at the start of each predetermined time period and each time the player succeeds in landing a ball in the scoring area. In this way each player attempts to land as many playing balls as possible in the scoring area within his or her predetermined time period. Thus, the player who is capable of landing the greatest number of balls in the scoring area within the given time interval may achieve a score or even win the game.

The timer mechanism may be also adapted to provide handicaps such that players of older age or greater skill may have a lesser amount of time in which to land their playing balls into the scoring area.

This invention possesses many other advantages and has other purposes which may be made more clearly apparent from a consideration of forms in which it may be embodied. These forms are shown in the drawings accompanying and forming part of the present specification. They will now be described in detail for purposes of illustrating the general principles of the inventions; although it is to be understood that such detailed descriptions are not to be taken in a limiting sense.

BRIEF DESCRIPTIONS OF THE DRAWINGS

Having thus described the invention in general terms, reference will now be made to the accompanying drawings in which:

FIG. 3 is a bottom plan view of the game apparatus of the present invention;

FIG. 4 is a fragmentary vertical sectional view taken along 4—4 of FIG. 3 and showing a portion of a ball ejecting mechanism of the present invention;

FIG. 7 is a fragmentary front elevational view, partially broken away and in section and showing a portion of the cooperation of the reset-locking mechanism and the playing table forming part of the apparatus of the present invention.

DETAILED DESCRIPTION OF A PREFERRED EMBODIMENT

Figure 1:
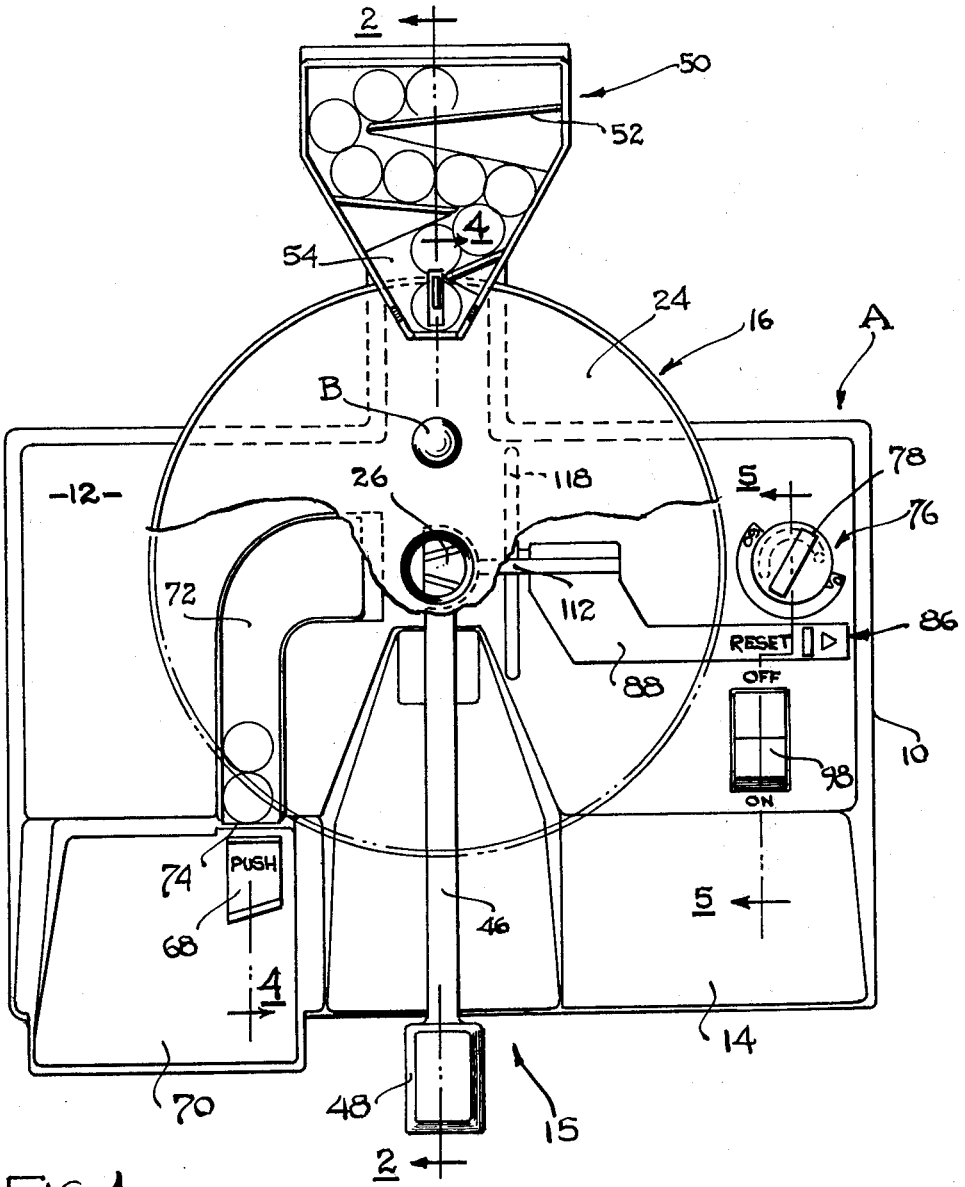
FIG. 1 is a top plan view of a game apparatus constructed in accordance with and embodying the present invention.
Figure 6:
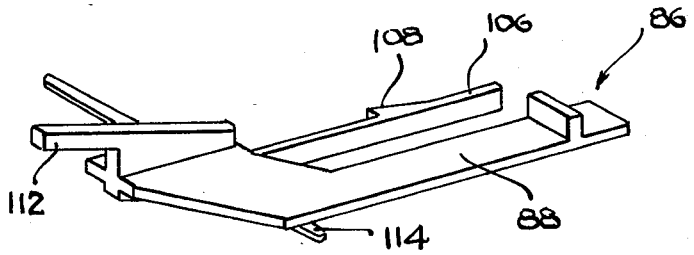
FIG. 6 is a perspective view of a reset-locking mechanism forming part of the apparatus of the present invention.

Referring now in more detail and by reference characters to the drawings, which illustrate a preferred embodiment of the present invention, A designates a time reaction game apparatus which generally comprises a base frame 10 having at least horizontally disposed wall 12 and which integrally merges into a downwardly sloping wall 14 leading toward a player end 15.

Figure 2:
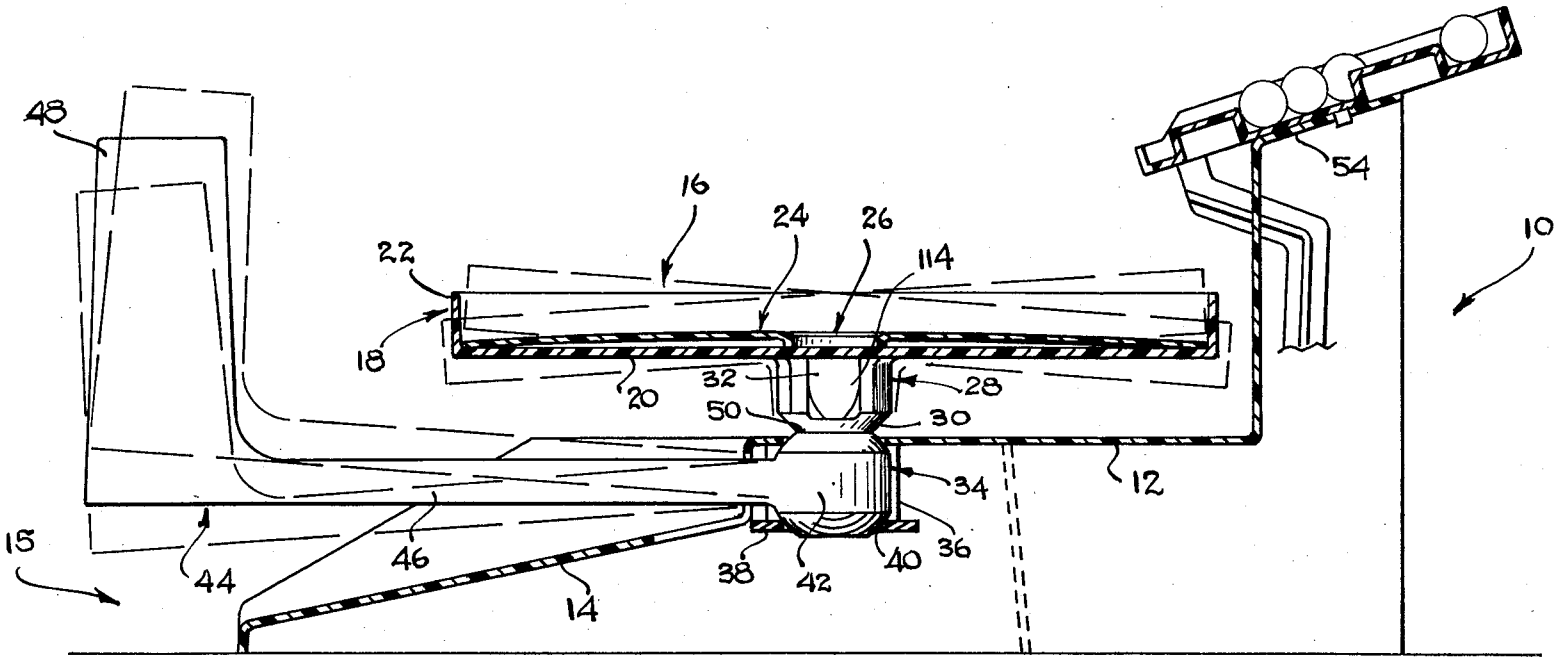
FIG. 2 is a vertical sectional view taken along line 2—2 of FIG. 1.

The apparatus comprises a tiltable table means 16 in the form of a table 18 having a bottom wall 20 and peripherally extending upstanding side wall 22 in the manner as illustrated in FIG. 2 of the drawings. The table 18 is often referred to as a playing board. Located on the upper surface of the bottom wall 20 is an insert plate or disc 24 which presents a crowned or convex upper surface and which has a high point at the center thereof leading to a goal area 26 in the form of an aperture in the plate 24. Mounted on the underside of the bottom wall 20 forming part of the table 18 is a downwardly projecting hub 28 which has a lower camming surface 30 for reasons which will presently more fully appear. In addition, the hub 28 is interiorly bored in order to provide a recess 32 communicating with the aperture 26 and which recess also forms part of the goal area.

Located in the base frame 10, and particularly in the region where the horizontal wall 12 extends into the downwardly inclined wall 14 is a socket 34. This socket 34 may be formed by a somewhat vertically disposed symetrically shaped wall 36 extending downwardly from the horizontally disposed wall 12 on the base frame 10 and a horizontally disposed flat plate 38 extending rearwardly from the downwardly inclined wall 14, in the manner as illustrated in FIG. 2 of the drawings. Further, plate 38 provided with a lower aperture 40 in order to receive a support bearing 42, also in the manner as illustrated in FIG. 2 of the drawings.

It can be observed that the support bearing 42 forms part of a manually actuable mechanism 44 such as a so-called "joystick" for causing tiltable movement of the table means 16. In this case, the manually actuable mechanism 44 comprises a lever arm 46 which is secured to and extends outwardly from the bearing 42 toward the player ends 15 as in the manner as illustrated in FIGS. 1-3 of the drawings.

Integrally formed with the lever arm 46 is an upstanding handle 48 which is engageable by the player of the apparatus and which is remotely located with respect to the table 18.

By further reference to FIG. 2 of the drawings, it can be observed that the bearing 42 was initially a spherical element and which was machined or otherwise formed with a relatively flat top face 50 engaging the camming face 30 on the hub 28. Moreover, the bearing 42 is similarly provided with a spherically shaped wall section which fits within the aperture 40 in the plate 38. In this way, the bearing 42 serves as a type of "universal" joint such that the manually actuable mechanism 46 is universally movable. In other words, the handle 48 and hence the lever arm 46 can be shifted upwardly or downwardly in order to cause the table means 16 to shift back and forth, to the positions as illustrated in the phatom lines in FIG. 2. However, by shifting the handle 48 to either of the sides that is to the left side or right side, reference being made to FIG. 1, the table will similarly tilt to the left or right sides of the frame 10.

The above described construction permits the player of the game apparatus to move the manually actuable means 44 in order to tilt the table means 16 to a position where a playing ball B will roll into the goal 26.

As stated previously, the manually actuable means 44 presently exists in the form of a joystick. However, it should be understood that any form of manually actuable member which is operatively connected to the table to cause tilting movement of the same could be employed in accordance with the present invention. It is generally important to have a manually actuable means engageable by the operator at a point remote from the table means 16 so that the operator does not interfere with the movement of the table means 16. In the same respect, it is desirable to have a convex or crowned upwardly presented surface on the plate 22. It should be understood that the plate 22 could be designed so that only a portion of its upper surface is convex and with the goal located at the center of the convex portion or otherwise in close proximity to the center of the convex portion. In either case, the player must engage the joystick or other manually actuable mechanism and attempt to cause the table to tilt in a direction where a ball will quickly roll into the goal area.

The game apparatus which is illustrated also comprises means to automatically dispense a new playing ball when a previous playing ball enters into the goal area. This means to dispense a playing ball comprises means for retaining a supply of the playing balls B in the form of a tray 51 having a plurality of baffles 52 located therein and which is inclined so as to form a chute 54. Located at the forward end of the chute, reference being made to FIGS. 1 and 4 is a pin 56 which projects through an aperture 58 formed in the bottom wall of the chute 54. The pin 56 forms part of an actuable release mechanism 60 or so-called "ejector mechanism" which is hereinafter described in more detail. By further reference to FIG. 4, it can be observed that the pin 56 will normally lie below the aperture 58, but when actuated will raise upwardly through the aperture 58 and engage one of the playing balls B and force the same, e.g. kick the same over a lip 62 at the forward end of the chute 54. When a ball rolls down the chute 54, it will be engaged by and stopped at the lip 62 until ejected as aforesaid.

The ball dispensing mechanism 60 also comprises a depressible rod 64 which is pivoted about a pivot pin 66 extending through the base frame 10, in the manner as illustrated in 64. The rod 64 is connected to a rod 67 which is provided with the pin 56 at its upper end by a plurality of links 69 as illustrated in FIG. 3. The rod 64 terminates at its outer end in the form of a small cup 68 which is capable of being depressed on receiving playing ball B and being forced downwardly by the weight thereof. In addition, the cup 68 also serves as a manually actuable mechanism such that it can be engaged by the finger of the player and pushed downwardly in order to cause a playing ball to be ejected from the chute 54.

The cup 68 lies within a "dead ball" area 70 formed in the base frame 10, in the manner as illustrated in FIG. 1. The dead ball area 70 exists in the form of a recessed area and is designed to receive balls which enter into the goal area 26. In this case, a ball which enters into the aperture 26 passes through the recess 32 and into a chute 72 which leads from the recess 32 into the dead ball area 70. Moreover, it can be observed that the chute 72 is provided with open end 74 immediately adjacent to the cup 68 so that a ball which moves through the chute 72 will engage the cup 68 to force the same downwardly and thereby cause the ejection of a new playing ball B.

The lower end of the chute 54 is located over the table 18, in the manner as illustrated in FIGS. 1 and 2 of the drawings so as to drop a ball directly onto the table. However, the chute 54 is located so that the lower end thereof is closer to the periphery of the disc or plate 24 so that any ball ejected therefrom will not land directly into the goal 26.

Figure 5:
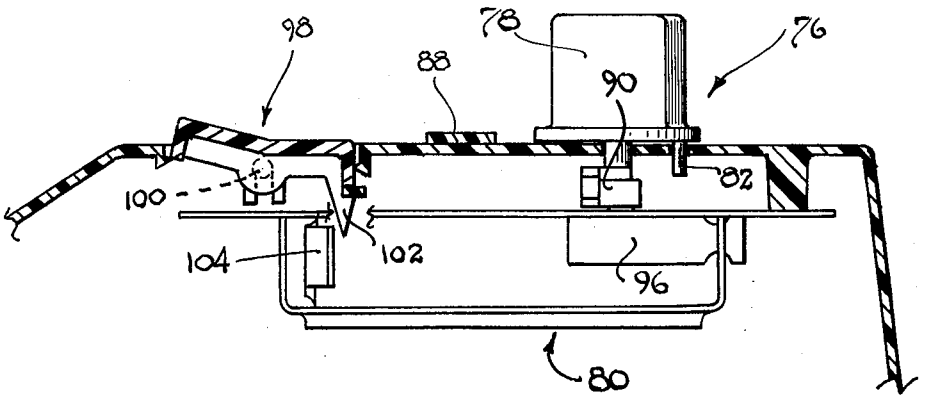
FIG. 5 is a fragmentary vertical sectional view taken along 5—5 of FIG. 1 and showing a portion of the timing and reset mechanism forming part of the game apparatus of the present invention.

Also located on the base frame 10, and particularly on the horizontal wall 12 thereof is a timing means in the form of a conventional timer 76 having a manually actuable timing knob 78 which energizes a spring-wound timing motor 80 more fully illustrated in FIGS. 1, 2 and 5 of the drawings. In this case, the knob 78 includes a downwardly struck pin 82 which extends a semi-circular groove 84 and actuates a locking means 86 in the form of a transversly shiftable bar 88, in a manner to be hereinafter described in more detail. In this case, the timing motor is a conventional spring operated wind-up timing motor and includes a gearing mechanism 90 which turns a coil spring 96 to place the same under tension. The conventional timing motor 80 would also include an escapement mechanism and like structure which is conventional in order to set a predetermined time interval. Inasmuch as this structure is conventional, it is neither illustrated nor described in any further detail herein.

The timer mechanism 76 operates in conjunction with an off-on switch 98 also more fully illustrated in FIGS. 1 and 5 of the drawings. In this case, the off-on switch 98 is pivoted on a pin 100 journalled in the base frame 10. Moreover, the off-on switch 98 includes a downwardly projecting flange 102 which engages an element 104 connected to the timing motor 80. Thus, when the element 104 is engaged, it will stop the operation of the timing motor. Moreover, when the switch 98 is pushed so that the left hand portion thereof is pushed downwardly, reference being made to FIG. 5, then the flange 102 will be moved out of the position of the element 104 thereby permitting the timing motor 80 to count down in the pre-established interval. Again, the actual construction of connecting the timing motor 80 to the element 104 is conventional and therefore neither illustrated nor described in any further detail herein.

The locking means is more fully illustrated in FIGS. 1, 3, 6 and 7 of the drawings and comprises the transversely extending bar 88, as aforesaid. The locking means 86 also comprises a transversely extending arm 106 which is offset from and parallel to the bar 88. Moreover, the arm 106 includes an outwardly extending shoulder 108 which is engageable by a projection 110 on the under surface of the base frame wall 12, in the manner illustrated in FIGS. 3 and 6 of the drawings. When referring to FIG. 3, it can be observed that the locking means is in the reset position that is, the goal 26 is not blocked. However, when the timer motor 80 has caused the pin 82 to completely move through the arcuate slot 84, the pin 82 will engage the shoulder 108 and force the arm 106 out of engagement with the abutment 110. As this occurs, the bar 88 will be permitted to shift to the left (reference being made to FIG. 1) and to the right (reference being made to FIG. 3).

The bar is biased so that a projection 112 on the forward end thereof will extend into an opening 114 on the hub 28 so as to lock the hub and also to block any balls from falling into the recess 32, when the bar 88 has been fully shifted to the left (reference being made to FIG. 1).

The bar 88 is biased to the blocking position that is the position where the projection 112 extends into the opening 114 and locks the table means 16 from further movement, by means of a thin leaf spring 115 which is captured by a pair of pins 116 and a depending flange 118 on the underside of the base frame 10. Thus, as the shoulder 108 is released from the projection 110, the bar 88 and hence the locking means 86 is biased to the goal blocking position so that the projection 112 will extend into the aperture 114 thereby blocking the goal area and also locking the tiltable table means 16 from further movement.

The game apparatus including the base frame and many portions of the apparatus could be formed of any of a number of plastic materials, including polyethylene, polystyrene, many of the vinyl polymers and co-polymers, and the like. In addition, these components could be formed as a unitary structure, or, otherwise formed as individual components which are secured together by means of adhesives or other conventional fastening means. In addition, the game apparatus as well as the playing balls and various portions of the game apparatus, including the components forming part of the timer mechanism and the like, could be formed of such plastic materials or other plastics in a number of known molding operations, as for example, blow-molding, ejection-molding, thermal forming, or the like. These various components may also be formed of other materials, such as various metals, or various known reinforced plastic materials, as for example, fiberglass-epoxy resin composites, or the like.

In the play of the game apparatus, which is illustrated, the one or more players will load a plurality of the balls B into the ball dispensing mechanism 51, in the manner as illustrated in FIG. 1. The balls will roll down into the chute 54 to the lower end thereof and to a position to where they are capable of being ejected onto the table 18. Before any of the balls are actually introduced onto the table 18, the player of the game will fully wind the timer mechanism 76 by rotation of the knob 78. At this point, the pin 82 will be located at the left-hand end of the semi-circular slot 84, in the manner as illustrated in FIG. 3 of the drawings. Further, the player will pull to the right (FIG. 1) on the bar 88 by means of an upwardly struck handle 120 integrally formed thereon so that the projection 112 is removed from the aperture 114 in the hub 28. This permits the table 18 to be tiltable and the recess 32 to be available for receiving any of the playing balls which are properly rolled through the opening 26. In addition, in order to start the play of the game, the player will simultaneously start the timer motor by actuating, e.g. manually pressing, the off-on switch 98 and also simultaneously the player will push downwardly on the cup 68 in order to release a ball from the chute 54, in the manner as previously described.

When the ball has been released from the chute 54, it will drop onto the playing surface of the playing table 18. The player will actuate the joystick by grasping the handle 48 and will attempt to tilt the table to a position where the ball rolls in through the aperture 26 and into the goal defined by the aperture 26 and the recess 32. At this point, the players will have achieved a score as for example, one point.

The game apparatus which is illustrated may also be provided with a scorekeeping means which automatically registers the score if desired. Otherwise, a manually operable scorekeeping means (which is conventional in construction) may also be mounted on the base frame 10, if desired.

As the ball passes through the recess 32, it will roll down the chute 72 and into the cup 68. As this occurs, the weight of the ball will be sufficient so as to bias the cup 68 downwardly. Further, the ejector pin 56 will thereby be forced upwardly causing another ball to be ejected from the chute 54 and onto the playing surface. The player of the game will thereby attempt to land this second ball and all subsequent balls which are ejected onto the playing surface into the goal as aforesaid. Thus, each player will attempt to introduce as many balls as possible into the goal area before the same is closed by the timer mechanism. The player introducing the largest number of balls into the scoring area will thereupon win the game or achieve a higher score level.

When the timer mechanism has completely run out of time, the pin 82 will engage the shoulder 108 on the arm 106 thereby forcing the bar 88 to the goal blocking position. The leaf spring 115 will force the bar 88 to the right, reference being made to FIG. 3 so that the projection 112 extends into the opening 114 thereby locking the table and also preventing further balls from entering into the goal area. In the same respect, it can be observed that the locking of the table effectively prevents the player from operating the joystick.

After the timer mechanism has closed the goal area from receiving further balls on the playing table, the extra ball which remains on the table may be physically removed from the playing table and reinserted into the ball dispensing mechanism 51. In like manner, all of the balls which have passed through the chute 72 into the dead-ball area 70 will also be placed back into the ball dispensing mechanism 51 for the start of a new play of the game. In the same respect, it should be understood that a separate chute leading to another "dead ball" area could be provided for receiving those balls which are on the playing table and which do not land in the goal area before the same is blocked.

It should be understood that the above described mode of play is only one mode of play in connection with the game of the present invention. For example, the game could be designed so that two or more playing balls are ejected onto the surface and the player is required to land two or more balls into the goal area during the predetermined time interval established by the timer.

Thus, there has been illustrated and described a unique and novel game apparatus in which one or more players attempts to manually actuate the remote control means for causing a tiltable table to shift in a manner where one or more playing balls can be rolled into a scoring area on a high portion of a crowned playing surface and within a predetermined time interval, and which therefore fulfills all of the objects and advantages sought therefore. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention or deemed to be covered by the invention which is limited only by the following claims.

Having thus described my invention, what I desire to claim and secure by Letters Patent is:

1. A game apparatus in which one or more players attempt to cause a playing ball to roll into a goal area, said game apparatus comprising:

(a) a tiltable game playing board having an upper playing surface which has a high portion and which surface has upwardly sloped portions that lead upwardly to said high portion, (b) a goal area at or near the high portion of said playing surface for receiving a playing ball, (c) remotely located manually operable control means operatively connected to said playing board to enable a player of the game apparatus to tilt the playing board in response to actuation of said control means so that the player can attempt to cause the ball to move up said upwardly sloped portions and into said goal area, and (d) timing means and playing board locking means operatively connected to said timing means to automatically lock said playing board after a predetermined time interval established by said timing means.

2. The game apparatus of claim 1 further characterized in that said playing surface is convex and said goal is located at the high point of said convex surface.

3. The game apparatus of claim 2 further characterized in that said manually operable control means comprises a joystick.

4. The game apparatus of claim 2 further characterized in that said game board is universally tiltable.

5. The game apparatus of claim 4 further characterized in that said apparatus comprises means for automatically introducing a new playing ball onto the playing surface after a previous playing ball has entered into the goal area.

6. The game apparatus of claim 4 further characterized in that said apparatus comprises goal blocking means operatively connected to said timing means to automatically block said goal area after a predetermined time interval established by said timing means.

7. The game apparatus of claim 4 further characterized in that said apparatus comprises goal blocking means operatively connected to said timing means to automatically block said goal area after a predetermined time interval established by said timing means, said timing means also automatically locking said manually operable control means after the predetermined time interval established by said timing means.

8. A game apparatus in which one or more players attempt to cause a playing ball to roll into a goal area, said game apparatus comprising:

(a) a tiltable game playing board having an upper playing surface, (b) a goal area in said playing surface for receiving a playing ball, (c) manually operable control means operatively connected to said playing board to enable a player of the game apparatus to move the playing board in response to actuation of said control means so that the player can attempt to cause the ball to move into said goal area, (d) a ball dispensing mechanism associated with said game board, (e) means operatively connecting said ball dispensing mechanism and said goal area so that said ball dispensing mechanism automatically dispenses a playing ball after a previous playing ball has entered the goal area, and (f) timing means and playing board locking means operatively connected to said timing means to automatically lock said playing board after a predetermined time interval established by said timing means.

9. The game apparatus of claim 8 further characterized in that said apparatus comprises goal blocking means operatively connected to said timing means to automatically block said goal area after a predetermined time interval established by said timing means.

10. The game apparatus of claim 8 further characterized in that said playing surface is convex and said goal is located at the high point of said convex surface.

11. The game apparatus of claim 10 further characterized in that the means operatively connecting said ball dispensing mechanism and goal area is also manually actuable by a player of said game apparatus.

12. The game apparatus of claim 11 further characterized in that said means operatively connecting said ball dispensing mechanism and goal area comprises a ball delivery chute from the goal area and a shiftable mechanism located to receive a ball delivered through said delivery chute to be actuable thereby.

13. The game apparatus of claim 12 further characterized in that said game board is universally tiltable.

14. A game apparatus in which one or more players attempt to cause a playing ball to roll into a goal area, said game apparatus comprising:

(a) a tiltable game playing table having an upper playing surface, (b) a goal area in said playing surface for receiving a playing ball, (c) manually operable control means operatively connected to said playing table to enable a player of the game apparatus to tilt the playing table in response to actuation of said control means so that the player can attempt to cause the ball to move into said goal area, (d) timer means operatively associated with said playing table for establishing a predetermined time interval of play of the game apparatus, (e) goal blocking means operatively connected to said timing means for automatically blocking said goal area from receiving a playing ball after the predetermined time interval, and (f) control locking means operatively associated with said goal blocking means to automatically lock said manually operable control means after a predetermined time interval established by said timing means.

15. The game apparatus of claim 14 further characterized in that said playing surface has a high portion and the playing surface has upwardly sloped portions that lead upwardly to said high portion, and said goal area is located at or near the high portion of said playing surface.

16. The game apparatus of claim 15 further characterized in that said apparatus comprises means for automatically introducing a new playing ball onto the playing surface after a previous playing ball has entered into the goal area.

17. The game apparatus of claim 14 further characterized in that said playing surface is convex and said goal is located at the high point of said convex surface.

18. The game apparatus of claim 14 further characterized in that said manually operable control means comprises a joystick.

19. The game apparatus of claim 19 further characterized in that said goal area comprises an opening in the playing surface and a recess beneath said opening to receive the playing ball.

20. The game apparatus of claim 19 further characterized in that said goal blocking means comprises a shiftable member coupled to said timing means and having an element which extends into said recess when said shiftable member is shifting to the goal blocking portion to thereby prevent any ball from passing into said recess.

21. The game apparatus of claim 20 further characterized in that said goal blocking means is manually resetable to start a new play of the game apparatus.

22. A game apparatus in which one or more players attempt to cause a playing ball to roll into a goal area, said game apparatus comprising:

(a) a tiltable game playing table having an upper playing surface, (b) a goal area game in said playing surface for receiving a playing ball, (c) manually operable control means operatively connected to said playing table to enable a player of the game apparatus to tilt the playing table in response to actuation of said control means so that the player can attempt to cause the ball to move into said goal area, (d) timer means operatively associated with said playing table for establishing a predetermined time interval of play of the game apparatus, and (e) table locking means operatively connected to said timing means for automatically locking said table from movement after the predetermined time interval.

23. The game apparatus of claim 22 further characterized in that said playing surface has a high portion and the playing surface has upwardly sloped portions that lead upwardly to said high portion, and said goal area is located at or near the high portion of said playing surface.

24. The game apparatus of claim 23 further characterized in that said apparatus comprises means for automatically introducing a new playing ball onto the playing surface after a previous playing ball has entered into the goal area.

25. The game apparatus of claim 22 further characterized in that said playing surface is convex and said goal is located at the high point of said convex surface.

26. The game apparatus of claim 22 further characterized in that said manually operable central means comprises a joystick.

27. The game apparatus of claim 22 further characterized in that said apparatus comprises playing table locking means associated with said table locking means to automatically block said goal area after a predetermined time interval established by said timing means.

28. The game apparatus of claim 22 further characterized in that said apparatus comprises control locking means operatively associated with said table locking means to automatically lock said remotely located manually operable control means after a predetermined time interval established by said timing means.

29. The game apparatus of claim 22 further characterized in that said goal area comprises an opening in the playing surface and a depending member on said table having a recess beneath said opening to receive the playing ball, said depending member also having an aperture in a side portion thereof.

30. The game apparatus of claim 29 further characterized in that said table locking means comprises a shiftable member coupled to said timing means and having an element which extends through said aperture and into said recess when said shiftable member is shifted to the table locking position to thereby prevent further movement of said table.

31. The game apparatus of claim 30 further characterized in that said table locking means is manually resetable to start a new play of the game apparatus.

32. A game apparatus in which one or more players attempt to cause a playing ball to roll into a goal area, said game apparatus comprising:

(a) a tiltable game playing board having an upper playing surface which has a high portion and which surface has upwardly sloped portions that lead upwardly to said high portion, (b) a goal area at or near the high portion of said playing surface for receiving a playing ball, (c) remotely located manually operable conrol means operatively connected to said playing board to enable a player of the game apparatus to tilt the playing board in response to actuation of said control means so that the player can attempt to cause the ball to move up said upwardly sloped portions and into said goal area, and (d) timing means and control locking means operatively connected to said timing means to automatically lock said remotely located manually operable control means after a predetermined time interval established by said timing means.

33. A game apparatus in which one or more players attempt to cause a playing ball to roll into a goal area, said game apparatus comprising:

(a) a tiltable game playing board having an upper playing surface, (b) a goal area in said playing surface for receiving a playing ball, (c) manually operable control means operatively connected to said playing board to enable a player of the game apparatus to move the playing board in response to actuation of said control means so that the player can attempt to cause the ball to move into said goal area, (d) a ball dispensing mechanism associated with said game board, (e) means operatively connecting said ball dispensing mechanism and said goal area so that said ball dispensing mechanism automatically dispenses a playing ball after a previous playing ball has entered the goal area, and (f) timing means and control locking means operatively connected to said timing means to automatically lock said manually operable control means after a predetermined time interval established by said timing means.

34. A game apparatus in which one or more players attempt to cause a playing ball to roll into a goal area, said game apparatus comprising:

(a) a tiltable game playing table having an upper playing surface, (b) a goal area in said playing surface for receiving a playing ball, (c) manually operable control means operatively connected to said playing table to enable a player of the game apparatus to tilt the playing table in response to actuation of said control means so that the player can attempt to cause the ball to move into said goal area, (d) timer means operatively associated with said playing table for establishing a predetermined time interval of play of the game apparatus, (e) goal blocking means operatively connected to said timing means for automatically blocking said goal area from receiving a playing ball after the predetermind time interval, and (f) playing table locking means associated with said goal blocking means to automatically lock said playing table after a predetermined time interval established by said timing means.

* * * * *